US006351202B1

(12) United States Patent
Ito et al.

(10) Patent No.: US 6,351,202 B1
(45) Date of Patent: Feb. 26, 2002

(54) STATIONARY INDUCTION APPARATUS

(75) Inventors: Keiichi Ito; Kosei Tsuji; Taketoshi Hasegawa; Noboru Hosokawa; Kiyoyuki Ishikawa; Yasuo Toba; Yasuji Yoshizumi, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/577,615

(22) Filed: May 25, 2000

(51) Int. Cl.[7] ..... H01F 27/20; H01F 27/32

(52) U.S. Cl. ..... 336/15; 336/206; 336/181; 336/195

(58) Field of Search ..... 336/206, 15, 205, 336/208, 182, 181, 195

(56) References Cited

FOREIGN PATENT DOCUMENTS

| | | | |
|---|---|---|---|
| JP | 60-210822 A | * | 10/1985 |
| JP | 61053710 A | * | 3/1986 |
| JP | 63047914 A | * | 2/1988 |
| JP | 10-006350 | | 1/1998 |
| WO | WO 97/45847 | | 12/1997 |

* cited by examiner

*Primary Examiner*—Anh Mai
(74) *Attorney, Agent, or Firm*—Leydig, Voit & Mayer, Ltd.

(57) ABSTRACT

A stationary induction apparatus superior in insulating ability against a surge voltage includes a coil piece on a line end side surrounded by one electrostatic shield insulating layer. The coil piece and electrostatic shield insulating layer, together with another coil piece, are surrounded by another electrostatic shield insulating layer, thus forming a successively nested configuration. Each of the electrostatic shield insulating layers includes an electrical insulating layer of pressboard and first and second conductive layers respectively located on inner and outer surface sides of the electrical insulating layer, The capacitance of each of the electrostatic shield insulating layers is adjusted to control an electrical potential distribution upon application of a surge voltage.

14 Claims, 5 Drawing Sheets

STATIONARY INDUCTION APPARATUS

BACKGROUND OF THE INVENTION

1. Field of the Invention

The present invention relates to a stationary induction apparatus such as a transformer or a reactor, and more particularly to an insulating structure for a winding thereof.

2. Description of the Background Art

A transformer is a stationary induction apparatus including two windings. The transformer has come into widespread use in power systems for transmission of electric power, and is for transforming a current value and a voltage value through the use of electromagnetic induction between identical frequency circuits. Furthermore, a reactor is composed of one or more windings, and is for adding an inductance to an electric circuit or a power system. In general, among internal cooling modes, there are oil cooling, gas cooling, liquid cooling, and air cooling, while among external cooling modes, there are air cooling, water cooling, and other types of cooling. Additionally, among magnetic circuits, there are an iron core formed by stacking silicon steel plates and an air core having no iron core.

In any case, parts of an electric conductor forming a winding carry different voltages. For insulation between electric conductors, there have been employed insulating methods, such as an oil filled mode using an insulating oil and a fibrous insulating material, a sulfur hexafluoride ($SF_6$) gas filled mode, a resin mold mode, and others. In general, these insulation means comprise a combination of a plurality of materials or layers differing from each other in insulating ability. In one concept, in a conventional transformer or reactor, to enhance the overall insulating ability, an insulating medium such as oil, gas, or air, having a lower insulating ability than a solid, is subdivided by solid insulating layers to shorten the distance in the insulating medium. For example, as mentioned in the "Electrical Engineering Handbook" of the Institute of Electrical Engineers of Japan, 1988, pp. 673–674, the conventional transformer is constructed such that each of the oil layers among a high-voltage winding, a low-voltage winding, an iron core and a tank is divided by insulating partitions made from inter-layer insulating paper. It has been known that the insulating ability of this oil layer per unit distance improves by distance-reduction of the width of the oil layer. That is, the shortening of the width distance of the oil layer, divided by the insulating partitions made from the inter-layer insulating paper, not only enhances dielectric strength but also improves the insulating ability between the windings in addition to suppressing discharge phenomena, provided by the insulating portions, which causes dielectric breakdown. Likewise, in a gas insulating device, as is known from Paschen's law, the gas section is divided for the distance-reduction of the width of each gas layer, thereby boosting the dielectric breakdown electric field.

Furthermore, a problem in insulation arising in the conventional oil filled transformer relates to an electrification phenomenon called "flow electrification". In general, in an oil filled transformer, an oil is circulated from a lower portion of a winding to an upper portion thereof for cooling. When this oil comes into contact with an insulating material surface, charge transfer takes place in the vicinity of the boundary between the oil and the insulating material. In addition, the charge transferred due to the oil flow is carried away to cause charge separation. Accordingly, the oil and the insulating material are electrified in reverse polarity. If the electrified charge is accumulated on the surface of the insulation material, a strong electric field appears partially in a surface along an oil layer or an insulating member, which results in abnormal insulation. To prevent this flow electrification, there are countermeasures: (1) restraining the oil flow rate to below some limit by utilizing the characteristic in which the charge quantity decreases with a decrease of the oil flow velocity, and (2) adding an additive to the oil to suppress charge-transfer.

Japanese Unexamined Utility Model Application Publication No. (SHO) 58-175618 discloses a technique in which, to achieve the insulation distance reduction, insulating paper is placed to run among cylindrical windings so that the filling is made with the insulating paper. This utilizes the fact that an oil immersed solid insulating layer has a higher insulating ability than an oil layer. However, irregularities on the winding surfaces are unavoidable due to its structure and manufacturing precision, which indicates that difficulty will be encountered in practice in bringing the insulating paper into close contact with the windings. If an oil layer exists on the winding surfaces, an electric field is concentrated in the oil layer due to the difference in dielectric constant between the insulating paper and the oil. Additionally, as mentioned above, since the oil layer is inferior to the insulating paper layer in insulating ability, a poor insulation structure is formed. Accordingly, it is difficult for the insulating paper to display the entirety of its insulating ability.

So far, a method of preventing such a drawback in the insulation structure has been employed for high-voltage rotating machines. For a stator winding of a high-voltage rotating machine above 1 kV, a winding called "formed-coil" has been put to use. This has a construction in which a plurality of insulation-coated conductors are bundled and covered with a composite solid insulation of a synthetic resin and mica, and further is inserted into a slot made in an iron core. Gaps develop between these conductors and the solid insulation and between the solid insulation and the iron core due to stress or deterioration occurring, for example, in the manufacturing process, at the start/stop or during the operation, which constitutes a weak point on insulation and causes partial discharge. A way to prevent this is described in "Manufacturing and Maintenance of Electric Coil" 1990, p.133, translated by Hisayasu Mitsui, et al. published by Kaihatsusha (from the original by H. Seuentz, "Herstellung der Wicklungen electrischer Maschinen"). That is, a semi-conductive layer called an internal corona shield is placed inside a solid insulation and between the solid insulation and a conductor so that the same electric potential is maintained with respect to the conductor, while a semi-conductive layer called an external corona shield is placed outside the solid insulation and between the solid insulation and an iron core to maintain the identical electric potential with respect to the iron core. At this time, the semi-conductive layer is constructed to have a high adhesive strength with respect to the solid insulation so that a gap more easily occurs between the semi-conductive layer and the conductor or between the semi-conductive layer and the iron core. Accordingly, even if a gap develops between the semi-conductive layer and the conductor or between the semi-conductive layer and the iron core, the electric field in the interior of the gap is relieved, thereby suppressing the occurrence of partial discharge and preventing the occurrence of weak points in the insulation structure.

If an insulating structure, in which both surfaces of a solid insulation extending perpendicularly to the electric field applying direction are covered with a semi-conductive material as mentioned above, is applied to a transformer or a reactor, then the lowering of the insulating ability may be prevented and the reliability may be improved. Such an insulating structure for a transformer or a reactor is disclosed, for example, in Japanese Unexamined Patent Application Publication No. (HEI) 10-6350 or in PCT International Publication No. W097/45847. However, a conventional high-voltage rotating machine is constructed such that, in the entire winding, the insulation has the same thickness, and the electrical fields in the insulation differs greatly at a high-voltage section of the winding and at a low-voltage section thereof. In other words, in the low electrical field section of the insulation, a greater volume than is needed is used for insulation, and there is room to increase the space factor of the conductor and the iron core. Additionally, since different materials are combined in the solid insulation of a high-voltage rotating machine, when an internal stress occurs, a gap develops at a weak portion in the boundary face between the materials to accelerate the deterioration, which shortens the insulation life.

A description will be given hereinbelow of the PCT International Publication No. W097/45847. This relates to a transformer or a reactor having a winding formed by winding an insulating conductor, similar to a solid power cable comprising a first semi-conductive layer, a solid insulating layer and a second semi-conductive layer arranged coaxially, in that order, from the inside. This PCT International Publication describes that the portion between the conductors is insulated with a solid insulation surrounded by the semi-conductive layers so that the entire voltage is maintainable with the solid insulating layer having a high insulation reliability. However, in the case of this conventional art, since the space factor is reduced for the following two reasons, the dimension increases. One reason is to use a uniform and thick insulating layer, necessary for withstanding the entire voltage during application of a surge voltage, in a portion that requires a different insulating performance at a normal voltage application to between the windings or between the winding and the iron core. The second is because the conductor used has a circular cross section so that a gap develops between the windings on the winding outer side. Additionally, in general, in the case of a solid insulation such as in this conventional art, defects tend to occur in the process of insulation formation in the interior of a solid insulating layer. Even if such defects in the solid insulation are microscopic so that the detection thereof by a test becomes difficult, during the apparatus life over several decades, the defect portions gradually advance causing a shortening of the apparatus life.

Among the electrical stresses the transformer or the reactor receives, in addition to the normal voltage, there may be a lightning surge voltage due to a lightning stroke and a surge voltage such as an opening/closing surge occurring in a circuit breaker, a disconnector, or the like. As stated in "Transformer Engineering" 1972, translated by Fumio Aoki, published by Corona Co., Ltd. (from the original: "Transformer Engineering" 1951, p.444, by L. F. Blume, et al. published by John Wiley & Sons, Inc.), upon application of a surge voltage, the voltage distribution of the winding differs from the normal voltage distribution, and the voltage sharing increases at the ends of a line constituting a highest voltage portion of the winding and at the ground ends or the series ends forming a lowest voltage portion, so that insulation reinforcement becomes necessary. One way to make the voltage distribution more uniform involves providing an electrostatic plate forming a line-potential electric conductor in a state adjacent to a coil existing at a line end and further placing an end-potential electrostatic plate in a state adjacent to a coil existing at the ground end or series end. Thus, the voltage sharing at the winding end portions is reducible at the application of a surge voltage.

Another way, which is more effective, involves reducing the grounded capacitance to bring the voltage distribution depending mainly on a series capacitance close to a normal voltage distribution depending on the inductance of the winding. Thus, for a coaxially arranged winding arrangement in which a plurality of windings are disposed coaxially, the conventional art has employed a method of placing an electrostatic shield in the exterior of the windings to increase the capacitance of the windings and the line ends for accomplishing a balance to the grounded capacitance or a method of adjusting the conductor disposition order in the winding to increase the series capacitance in the winding. However, these methods can disadvantageously complicate the winding manufacturing. Additionally, there is a problem in that the decrease of the grounded capacitance by the electrostatic shield is not applicable to an alternate disposition winding in which a plurality of windings are wound alternately on an iron core.

As described above, in the case of the conventional stationary induction apparatus, for the reduction of the insulation distance, the oil layer section constituting a weak point is packed closely with insulating paper or the like. However, difficulty is encountered in practice in applying such a structure to all the oil gaps, such as between the winding and the insulating paper and between the insulating paper and the insulating paper. As in the case of a rotating machine, when both surfaces of a solid insulation extending perpendicularly to the electric field applying direction are covered with a semi-conductive material, a high insulation reliability is obtainable, but if this structure is used for a stationary induction apparatus, then the space factor decreases, thus increasing the apparatus volume. Additionally, in the case of the employment of only the solid insulation, defects that can shorten the apparatus life tend to occur in the manufacturing process. Moreover, since the winding grounded capacitance exists and the unequal series capacitance arises, the lack of uniformity of the voltage distribution occurs at the application of a surge voltage and the insulation distance is long. Moreover, the lack of uniformity of the initial voltage distribution creates a problem in that the following voltage oscillations also become intense.

SUMMARY OF THE INVENTION

Accordingly, the present invention has been developed in order to overcome the above-mentioned problems, and it is an object of the invention to provide a stationary induction apparatus which has superior insulation performance against a surge voltage and which is capable of removing a weak portion in insulation on a winding structure for reduction of an insulation dimension, and further of checking flow electrification.

In accordance with this invention, there is provided a stationary induction apparatus having a winding composed of a plurality of coil pieces and a plurality of electrostatic shield insulating layers surrounding the coil pieces, wherein each of the electrostatic shield insulating layers comprises an electric insulating layer, a first conductive layer placed on an inner surface side of the electric insulating layer, and a second conductive layer placed on an outer surface side of the electric insulating layer, and one or more of the coil pieces are surrounded by one of the electrostatic shield insulating layers to construct one coil/shield combination, while the coil pieces other than the coil pieces constructing the coil/shield combination and the coil/shield combination are surrounded by the electrostatic shield insulating layer other than the one electrostatic shield insulating layer.

In a case in which a stationary induction apparatus having a winding composed of a plurality of coil pieces and a plurality of electrostatic shield insulating layers surrounding the coil pieces is constructed such that, as stated above, each of the electrostatic shield insulating layers comprises an electric insulating layer, a first conductive layer placed on an inner surface side of the electric insulating layer and a second conductive layer placed on an outer surface side of the electric insulating layer and one or more of the coil pieces are surrounded by one of the electrostatic shield insulating layers to construct one coil/shield combination while the coil pieces other than the coil pieces constructing the coil/shield combination and the coil/shield combination are surrounded by the electrostatic shield insulating layer other than the one electrostatic shield insulating layer, since the grounded capacitance of the coil pieces are shielded so that the voltage distribution at the surge voltage application effectively depends only upon the series capacitance resulting from the electrostatic shield insulating layers to make the voltage developing between the coil pieces more uniform as compared with the conventional art, the local high stresses at winding end portions are reducible to contribute to the improvement of the insulation performance with respect to the surge voltage. In addition, it is possible to eliminate an insulation weak point section without strictly forming an insulating structure in which, for example, the oil layer section forming the weak-point portion is packed closely with insulating paper or the like as in the conventional art, and further to shorten the insulation distance. Moreover, when an oil is circulated for cooling purposes, in the electrostatic shield insulating layer, the conductive layer relieves the electrified charge growing in conjunction with a flow of the cooling oil on a surface of the insulating layer to restrain the flow electrification. This can prevent distortion of the electric field by the electrified charge and can reduce a possibility of the occurrence of insulation abnormality stemming from the flow electrification.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENTS (First Preferred Embodiment)

Figure 1:
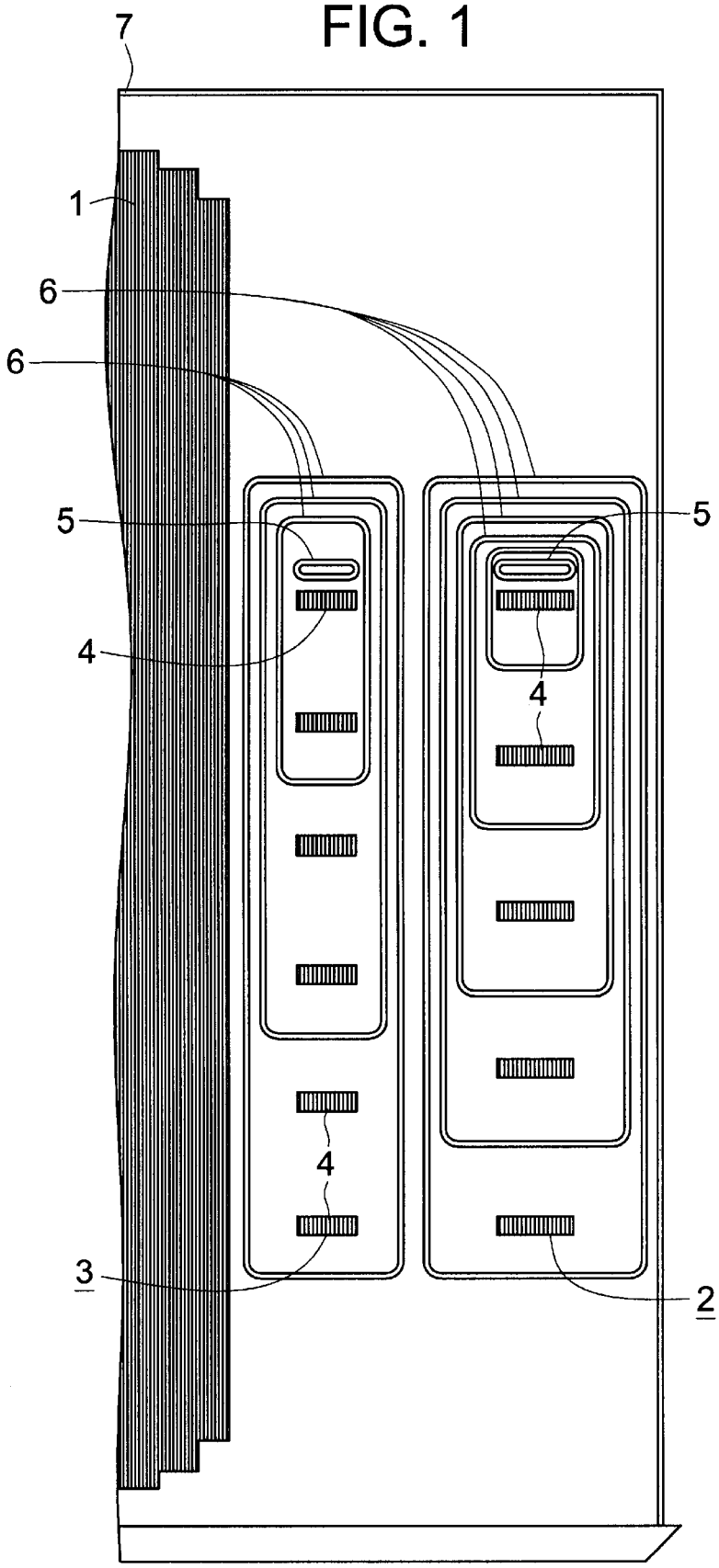
FIG. 1 is a cross-sectional view showing a transformer according to a first preferred embodiment of the present invention.
Figure 5:
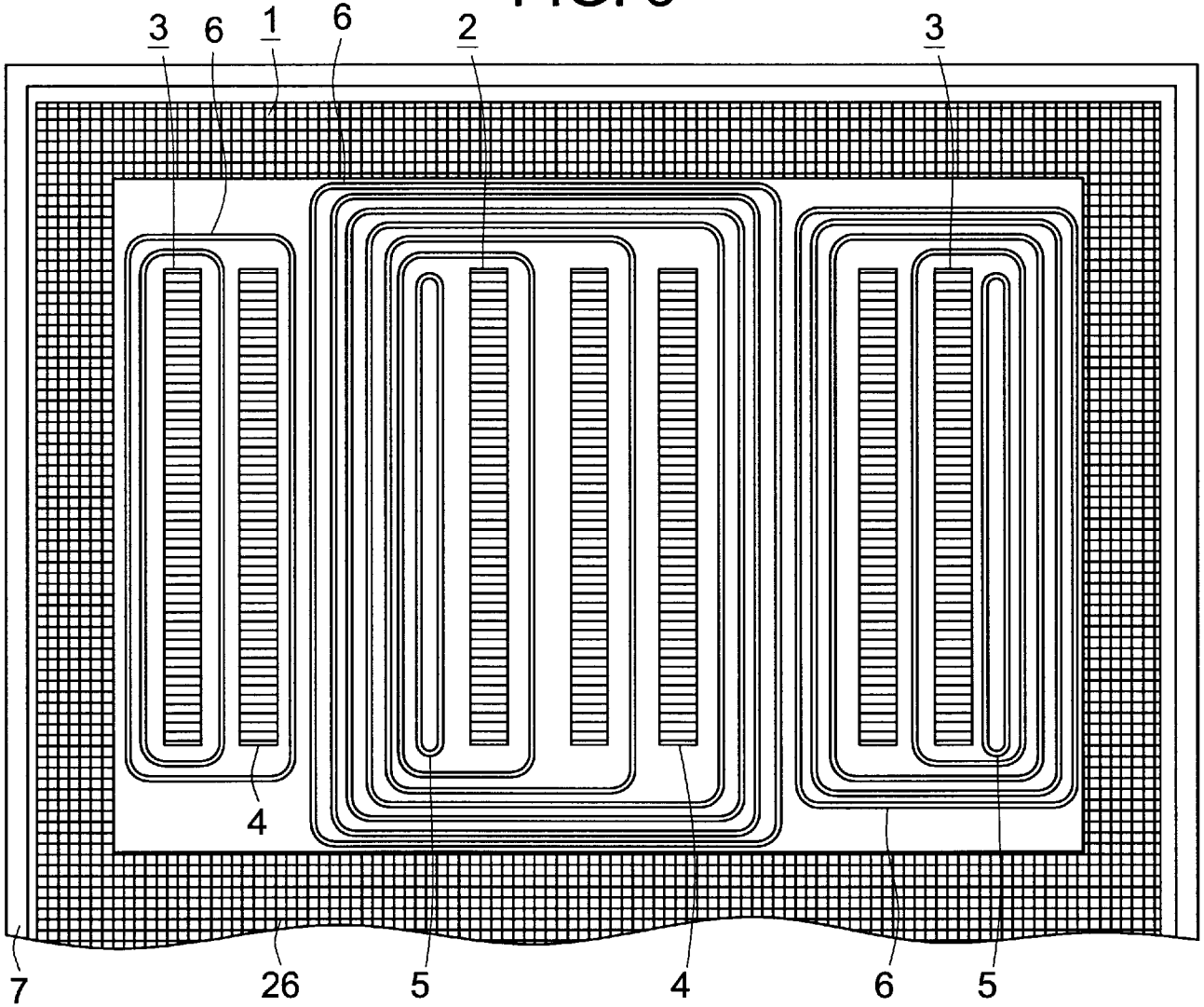
FIG. 5 is a cross-sectional view showing a transformer according to a second preferred embodiment of this invention.

FIG. 1 is a cross-sectional view showing approximately the right-half section of a transformer forming a stationary induction apparatus according to a first preferred embodiment of the present invention, with the left-half section, having a construction similar thereto, omitted from the illustration, thus providing a core type transformer. Incidentally, in fact the number of coil pieces 4 is larger, and in FIG. 1, merely to facilitate understanding, coil pieces 4 and electrostatic shield insulating layers 6 are shown reduced in number (FIG. 5 is shown similarly).

In FIG. 1, reference numeral 1 represents an iron core constituting a magnetic circuit, and reference numerals 2 and 3 respectively designate a high-voltage winding and a low-voltage winding provided on the iron core 1 to be coaxial therewith. Each of the high- and low-voltage windings 2 and 3 is constructed by vertically stacking a number of disc-like coil pieces 4 and successively connecting them, and is formed into a cylindrical configuration as a whole. The low-voltage winding 3 is disposed outside the iron core 1 and the high-voltage winding 2 is located outside the low-voltage winding 3. Furthermore, reference numeral 6 denotes a plurality of electrostatic shield insulating layers provided in connection with the high- and low-voltage windings 2 and 3 and shaped into configurations surrounding the coil pieces 4, that is, formed into hollow ring-like configurations, with the hollow sections accommodating the coil pieces 4 to allow nesting. Reference numeral 5 indicates capacitors situated on the line end sides (upper side in the illustration) of the high- and low-voltage windings 2 and 3, and are constructed similarly to the electrostatic shield insulating layers 6. These capacitors 5 are not made to surround the coil pieces 4. Reference numeral 7 indicates a tank accommodating the above-mentioned components 1 to 6, with the interior of this tank 7 being filled with an insulating oil.

Figure 2:
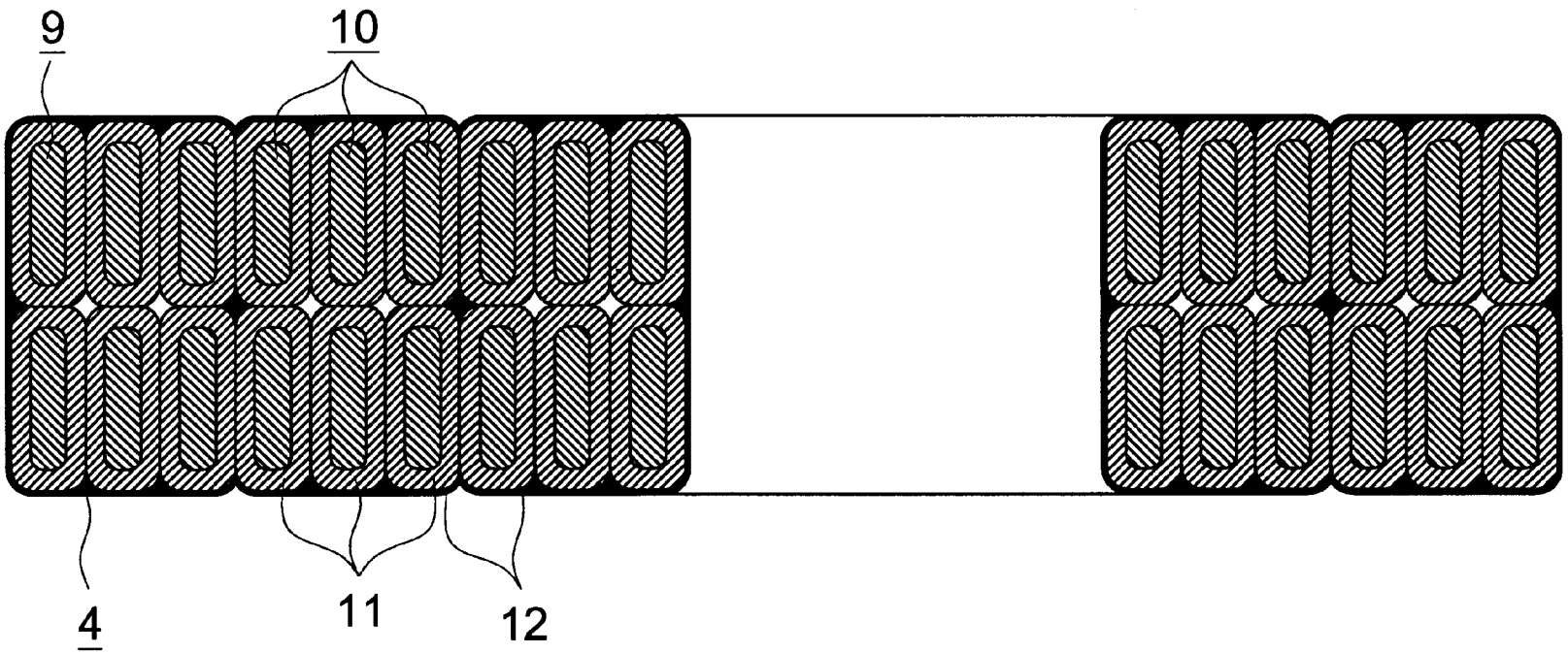
FIG. 2 is a cross-sectional view showing an arrangement of coil pieces of the transformer shown in FIG. 1.

FIG. 2 is a cross-sectional view showing the coil piece 4. In FIG. 2, reference numeral 9 indicates electrical conductors constituting current paths of the high- and low-voltage windings 2 and 3, which are made to run around the iron core 1. Reference numeral 10 indicates wires made with a straight angle line of a metal such as copper or a copper alloy having a high electrical conductivity, with one or more wires 10 forming the electric conductor 9 of each turn in a parallel condition. Reference numeral 11 indicates wire insulation placed on surfaces of the wires 10, with the wire insulation being formed by winding a plastic film or an insulating paper sheet, alternatively by baking-coating with an insulating material, thereby reducing the eddy current loss in the windings. Reference numeral 12 indicates turn insulation made on the surface of the wires 10 bundled in parallel, with the turn insulation being formed by winding a plastic film or an insulating paper sheet, thus achieving the insulation between the turns.

Figure 3:
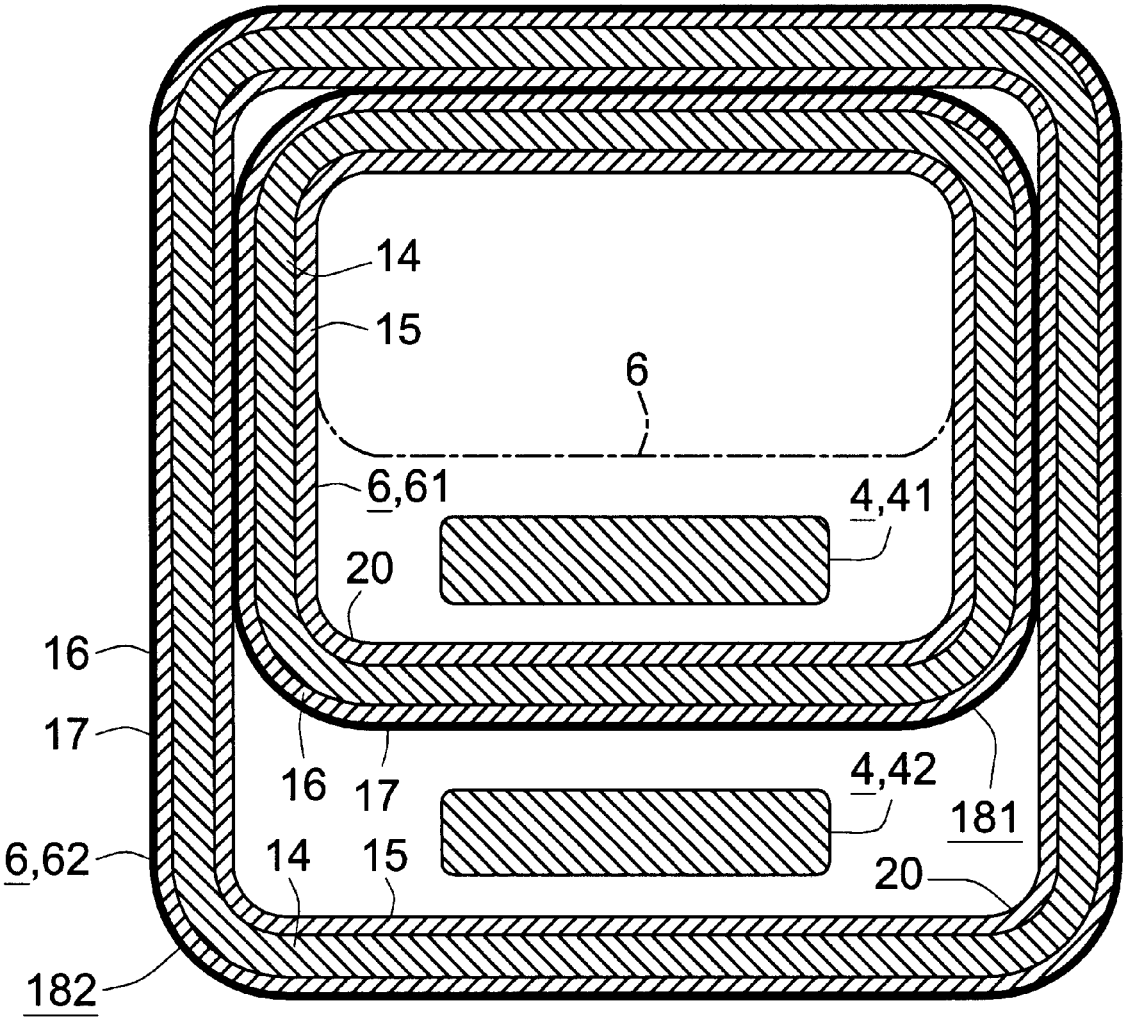
FIG. 3 is a cross-sectional view showing an electrostatic shield insulating layer of the transformer shown in FIG. 1.

FIG. 3 is a cross-sectional view showing an internal structure of the electrostatic shield insulating layer 6 and the disposition relation to the coil pieces 4. In FIG. 3, reference numeral 14 designates electrical insulating layers made of pressboard, with the electrical insulating layers being impregnated with insulating oil. The pressboard is a solid having continuous microscopic cavities, which are filled with a fluid (liquid or gas) (in this case, the insulating oil), thus forming a composite insulating layer. For this reason, even if defects occur in the interior of the insulation or in the boundary faces during the manufacturing process or due to deterioration with the passage of time, the aforesaid fluid enters the defect portions to prevent the lowering of the insulating ability. Reference numerals 15 and 16 respectively indicate first and second conductive layers placed to be brought into close contact with the inner surface side and the outer surface side of the electrical insulating layers 14. Reference numeral 17 indicates inter-layer insulating layers formed thinly to cover an outer surface side of the second conductive layers 16. It is also appropriate that the inter-layer insulating layers 17 be formed on the inner surface side of the first conductive layers 15. The aforesaid components 14 to 17 organize the electrostatic shield insulating layers 6. Incidentally, in the illustration, the layers 14 to 17 of the electrostatic shield insulating layer 6 are shown to have thickness greater than in actuality to facilitate understanding. With the above-mentioned construction, when oil is circulated for cooling purposes, in the electrostatic shield insulating layer the conductive layer relieves the electrified charge growing in conjunction with a flow of the cooling oil on the surface of the insulating layer to restrain the flow electrification. This can prevent distortion of the electrical field by the electrified charge and can reduce the probability of the occurrence of insulation abnormality stemming from the flow electrification.

One electrostatic shield insulating layer 61 surrounds one coil piece 41 to form one coil/shield combination 181, and another electrostatic shield insulating layer 62 surrounds that coil/shield combination 181 and another coil piece 42 to form a new coil/shield combination 182. In this way, as FIG. 1 shows, in the high- and low-voltage windings 2 and 3, as a whole, a plurality of electrostatic shield insulating layers 6 are disposed in a nested fashion while surrounding the coil pieces 4 successively from the line end side. Incidentally, in FIG. 3, although each of the coil pieces 41 and 42 is shown to be one in number, two or more coil pieces are also acceptable.

Thus, this construction of the electrostatic shield insulating layers 6 provides insulation between the coil pieces 4, between the high- and low-voltage windings, between the high- and low-voltage windings 2 and 3 and the iron core 1, and between the high- and low-voltage windings 2 and 3 and the tank 7.

A configuration of each of recess portions 20 appearing on inner sides of the corner sections of the electrostatic shield insulating layer 6 is made so that the recess portion of the electric insulating layer 14 has a radius of curvature greater than the thickness of the electric insulating layer 14. Accordingly, the electric field of the corner section does not concentrate in the electric insulating layer 14, and the distribution thereof is substantially uniform, thus resulting in improvement of insulating ability and reduction in the insulation distance. In contrast, a decrease in the radius of curvature thereof causes intensive electric field concentration in the electric insulating layer 14 of that section. However, too low curvature decreases the degree of freedom of the configuration of the electrostatic shield insulating layer 6. That is, difficulty is experienced in forming the configuration of the electrostatic shield insulating layer 6 into a desired shape depending upon the disposition relation to the coil piece 4. Thus, this is not preferable.

Furthermore, the first and second conductive layers 15 and 16 substantially cover entire inner and outer surfaces of the electric insulating layers 14. However, in order to prevent the first and second conductive layers 15 and 16 from suffering excessive heating and damage resulting from a flow of a circulating current in the first and second conductive layers 15 and 16 due to the main magnetic flux in the iron core 1 for inducing a winding voltage, for division, a small gap is made in at least one portion of each of the first and second conductive layers 15 and 16 so as not to form a fully closed curve around the iron core 1 through which the main magnetic flux passes.

The first and second conductive layers 15 and 16 are connected to one intermediate potential portion of the coil piece 4 for electrical potential control. Accordingly, the first conductive layer 15 and the second conductive layer 16 lying in the adjacent electrostatic shield insulating layers 6 are connected to each other. That is, in a description given with reference to FIG. 3, the second conductive layer 16 of the electrostatic shield insulating layer 6 is connected to one point of the intermediate potential portion, while the first conductive layer 15 of another electrostatic shield insulating layer 62 adjacent thereto is connected to the same point. In this way, the first conductive layers 15 and the second conductive layers 16 of the electrostatic shield insulating layers 6 are connected sequentially in adjacent condition. In FIG. 1, the second conductive layer 16 of the outermost electrostatic shield insulating layer 6 is connected to the other end side terminal 23, which will be described later with reference to FIG. 4, or a ground potential portion. Accordingly, since the numbers of turns of the plurality of coil pieces 4 are approximately equal to each other, the electrical fields in the electrical insulating layers 14 become approximately equal to each other between the electrostatic shield insulating layers 6, and the electrical fields outside the electrostatic shield insulating layers 6 reach zero. For this reason, it is possible to control or relieve the electrical field between the electrostatic shield insulating layer 6 and the coil piece 4, thus improving the insulating ability and shortening the insulation distance.

In addition, since the first conductive layer 15 and the second conductive layer 16 are made to be equal in electric potential to the coil pieces 4 existing inside and outside, the electrical fields among the first and second conductive layers 15, 16 and the coil pieces 4 are controllable and relievable, thus achieving improvement in insulating ability and shortening the insulation distance.

Moreover, since the second conductive layer 16 is made to be equal in electrical potential to the first conductive layer 15 of the electrostatic shield insulating layer 6 positioned outside to be adjacent thereto, there is no need to pay attention to the interrelationship between the configurations of both the conductive layers 15 and 16. In other words, it is possible to increase the degree of freedom on the configurations, and to concentrate the electrical field in the electrical insulating layer having a relatively high insulating ability. This contributes to improvement in insulating ability and shortening the insulation distance.

In other respects, the inter-layer insulating layer 17 takes care of the insulation between the first conductive layer 15 and the second conductive layer 16 of the electrostatic shield insulating layers 6 adjacent to each other. In this way, the neighboring first and second conductive layers 15 and 16 are brought into contact with each other at multiple points to form loops so that the magnetic fluxes interlink each other at the loops to prevent the occurrence of circulating currents.

From the above, for example, in the normal operation at application of the normal voltage, a voltage of the intermediate potential portion of the coil piece 4 to which the first and second conductive layers 15 and 16 are connected is applied to the electrostatic shield insulating layer 6. Accordingly, approximately half the sharing voltage of one coil piece 4 is applied to between the end portion of the coil piece 4 and the first conductive layer 15 standing on the inner side in the electrostatic shield insulating layer 6, while half the voltage of one coil piece 4 is likewise applied to between the second conductive layer positioned outside and the end portion of the coil piece 4 positioned outside thereof. Furthermore, these voltages are insulated at the oil passages among the first and second conductive layers 15 and 16 and the coil pieces 4. Thus, it is possible to minimize the differences in electric potential among the first and second conductive layers 15 and 16 and the coil pieces 4, and to achieve enhancement of the insulating ability and shortening the insulation distance. The connecting methods and connecting positions between the first and second conductive layers 15 and 16 and the coil pieces 4 and between the neighboring first and second conductive layers 15 and 16 are not limited to the above, but other appropriate modifications are also acceptable. Additionally, it is also appropriate that the electric potentials of the first and second conductive layers 15 and 16 be controlled with the divided voltage by the capacitance of the electrostatic shield insulating layer 6 in a state where the first and second conductive layers 15 and 16 are not connected to the coil pieces 4.

Figure 4:
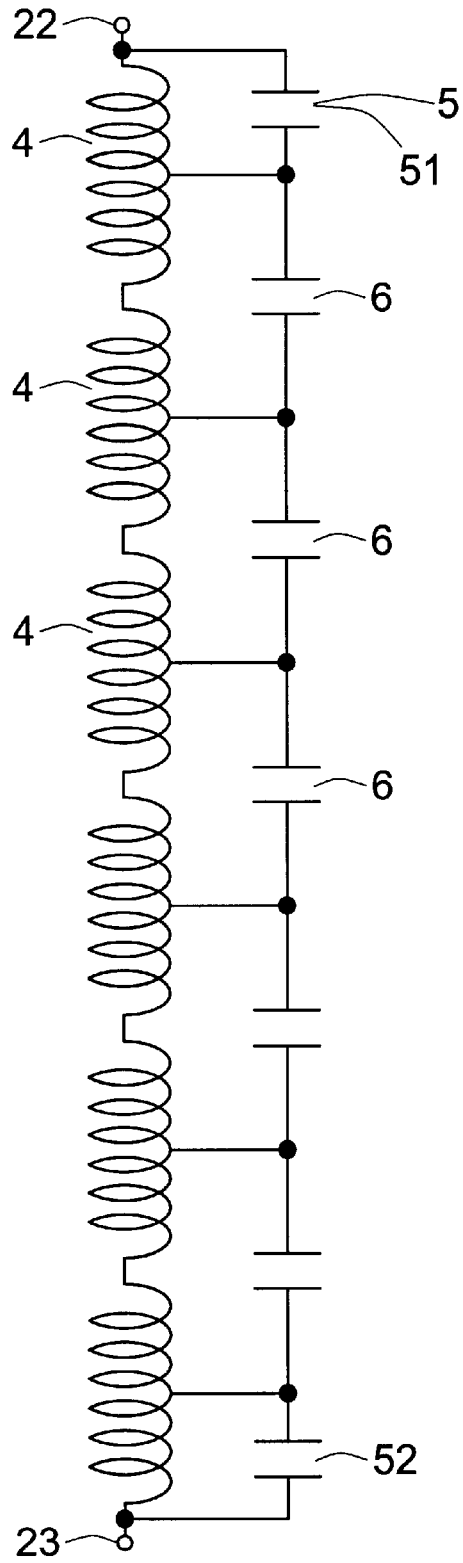
FIG. 4 is an equivalent circuit diagram for explaining voltage distribution of a winding in the transformer shown in FIG. 1.

FIG. 4 is an illustration of an equivalent circuit for explaining the voltage distribution of windings. In FIG. 4, reference numeral 22 designates a line side terminal which is connected to one end of a winding in the uppermost coil pieces 4 in FIG. 1. Reference numeral 23 denotes the other end side terminal to be connected to, for example, a grounding portion, a neutral point, another winding or the other end side of the line. This terminal 23 is connected to the other end of a winding in the lowermost coil piece 4 in FIG. 1.

In the electrostatic shield insulating layers 6, the thickness, area and dielectric constant of the electric insulating layers 14 are adjusted so that the capacitance between the first conductive layers 15 and the second conductive layers 16 are approximately equal to each other. A first conductive layer of a capacitor 5 is connected to the line side terminal 22, while a second conductive layer of the capacitor 5 is connected to the first conductive layer 15 of the innermost electrostatic shield insulating layer 6. For increasing this capacitance 51, it is also appropriate that another capacitor having a capacitance larger than the series capacitance between the conductors of the turns in the coil piece 4 be connected in parallel to the capacitor 5, or that this capacitor be connected in place of the capacitor 5. Additionally, it is also possible that a capacitor is connected in parallel to the outermost electrostatic shield insulating layer 6 to increase the capacitance 52. That is, it is also appropriate that a capacitor be connected between the first conductive layer 15 of the innermost electrostatic shield insulating layer 6 and the line side terminal 22 and/or between the first conductive layer 15 of the outermost electrostatic shield insulating layer 6 and the other end side terminal 23.

In this instance, the capacitance 51 and 52 at the end portions are set to be twice the capacitance of the electrostatic shield insulating layers 6. As illustrated, when the electrostatic shield insulating layers 6 are connected to the intermediate potential portions of the coil pieces 4, the winding range to which the capacitance 51 and 52 pertain comes to half the winding range involved in the electrostatic shield insulating layers 6. Accordingly, it is preferable that the capacitance 51 and 52 are set to be twice the capacitance of the electrostatic shield insulating layers 6 with respect to the electric field distribution to a surge voltage. Thus, since the numbers of turns of the plurality of coil pieces 4 are almost equal to each other, the voltage distribution to the surge voltage approaches the voltage distribution at the normal voltage, which permits the reduction of local high stresses at the winding end portions at the surge voltage application. This enables improvement in insulating ability and shortening of the insulation distance.

Since the series capacitance between the turns in the coil piece 4 is sufficiently less than that of the electrostatic shield insulating layer 6, the initial distribution distribution at the application of a surge voltage is determined substantially by the capacitance of the electrostatic shield insulating layer 6 and the series circuit of the capacitance 51 and 52. In addition, by adjusting the capacitance of the electrostatic shield insulating layer 6 and the electrostatic capacities 51 and 52, as mentioned above, the initial voltage distribution thereof is made to approach the normal voltage distribution depending upon the inductance of the winding. That is, the ratio of the voltage sharing between the coil pieces 4 is made to approach the ratio of the voltage sharing at the normal voltage. Thus, the local stress to the surge voltage decreases between the turns and between the coil pieces 4. Accordingly, in addition to improving the insulating ability to the surge voltage, it is possible to eliminate an insulation weak point section without strictly forming an insulating structure in which, for example, the oil layer section forming the weak-point portion is packed closely with insulating paper or the like as in the conventional art, and further to shorten the insulation distance. Moreover, the shortening of the insulation distance is feasible.

The pressboard used as a material for the electric insulating layers 14 is a high-density paper plate produced by scoop-screening, heating and pressing, and drying pulp made from cellulose. The pressboard shows a high impregnating capacity for an insulating oil, and shows a high insulating ability after the oil impregnation. Thus, it is possible to improve the insulating ability and further to shorten the insulation distance. This insulating ability develops because an insulating medium having a flowability penetrates fibers hardened at a high density to fill in gaps thereof. Even if a high-density polymer fibrous material other than cellulose is used, it is also possible to construct a composite insulation of a solid material and an insulating oil. This can offer effects similar to those mentioned above. Additionally, in the case of a laminated film made of a polymer material, since a general-purpose material, i.e., a film is put to use, it is possible to enhance the dielectric strength of each of layers made of a polymer material, and to form a composite insulation of a solid material and an insulating oil. This case can also provide effects similar to those mentioned above. For example, in the case of a material with thin layers produced by piling up mica or the like, although it shows a very good dielectric strength in the penetrating direction, if a high-anisotropy material showing a relatively low dielectric strength in a direction along layers is put to use and an insulating oil is put between the layers, it is possible to improve the insulating ability and to shorten the insulation distance. Moreover, also in the case of use of an insulating medium and a gas, similar effects are attainable.

Incidentally, in the above description, although a combined insulation is used for the electrostatic shield insulating layers 6, the use of a solid insulation can also offer effects similar to those mentioned above.

Furthermore, the first and second conductive layers 15 and 16 are made of a non-magnetic conductive material having a sheet resistivity of 1.01 to 10 W, preferably, approximately 0.1 W. As the materials for the first and second conductive layers 15 and 16, it is possible to employ films or screens made of metals such as copper, aluminum, stainless steel, or other conductive materials, and to further use conductive material mixed paper such as carbon mixed paper. Since the first conductive layer 15 and the second conductive layer 16 are made of a non-magnetic material, it is possible to control an electric field without disordering a magnetic field occurring when a current flows through an electric conductor, which contributes to the improvement of the insulating ability.

Furthermore, in the case of the employment of a conductive material mixed paper, such as carbon mixed paper, as a conductive layer, since it is a material having a coefficient of thermal expansion equivalent to that of an electric insulating layer, the configurational variation between the conductive layer and the insulating layer hardly occurs in conjunction with temperature variations, for example, in the manufacturing process, at start/stop, during operation. Additionally, when both the conductive layers and the electric insulating layer are brought closely into contact with each other, the stress at the boundary face from the temperature variations is reducible, thereby suppressing the occurrence of cavities between the layers. Since the first conductive layer and the second conductive layer are made with conductive material mixed paper, it is possible to control the first and second conductive layers to a desired surface resistance by selecting the length, thickness and density of the conductive material fiber. Moreover, in the case of the use of paper as the electric insulating layer, since the base material of the conductive material mixed paper is a paper, it is easily adhered to paper. Furthermore, since their coefficients of thermal expansion are close to each other, the drop in insulation reliability due to temperature variations or the like is preventable. Furthermore, the introduction of an insulating oil or the like into the electrical insulating layer is facilitated.

The upper limits of the sheet resistivity of the first and second conductive layers 15 and 16 are determined on the condition that the electrical potential in the same conductive layer is set constant to a surge voltage and on the condition that the heat generation due to a surge current is set below a predetermined limit. Additionally, the lower limits thereof are determined on the condition that the degree of an eddy current loss resulting from the interlinkage of magnetic fluxes in the first and second conductive layers 15 and 16 or the heat generation due to the eddy current loss is set below a predetermined limit. For restraining this eddy current loss, the first and second conductive layers 15 and 16 can also be formed into a comb-like configuration or the like to avoid a circulating current. In this case, even if the interlinkage of magnetic fluxes occurs in the first and second conductive layers, a circulating path with a large opening area for an eddy current does not develop, thus suppressing the eddy current loss. Moreover, the impregnation with an insulating oil in the electric insulating layer is facilitated.

Moreover, in a case in which the first conductive layer and the second conductive layer are made with a conductive screen, it is possible to control the conductive layers to a desired sheet resistivity by selecting the material composition, line diameter and structure of the screen, which can suppress the heat generation in the conductive layers due to the charging current or the heat generation due to the eddy current loss. Additionally, the impregnation with an insulating oil or the like into the electrical insulating layers is facilitated. Moreover, in a case in which, for the first and second conductive layers 15 and 16, a material is used having a coefficient of thermal expansion identical to or close to that of the electrical insulating layer 14, even if temperature variations occur in the process of manufacturing or during operation, the stress to be produced at the boundary surfaces between the conductive layers and the insulating layers is lowered to a small value, so the occurrence of defects is reducible.

The electrostatic shield insulating layers 4 surround the coil pieces 4 as shown in FIG. 1, and there is a need to make through holes in the electrostatic shield insulating layers 6 at connection lead portions to the external, crossover connecting portions between the coil pieces 4 and at outlet/inlet for the cooling medium. In this case, since the electrical field concentrates at the through-hole formation portions of the first and second conductive layers 15 and 16, that is, the conductive layer end portions, an electrical field relieving structure is provided. This electrical field relieving structure can increase the curvatures at the conductive layer end portions, and can use a structure in which the through-hole end portions are covered with insulating materials. In addition, it is also appropriate that one or a plurality of electrical field relieving electrodes be separately placed in the vicinity of the through holes. Moreover, it is also possible that the electrical field relieving structure at the conductive layer end portions be made to prevent a high electrical field by utilizing a non-linear resistance material.

(Second Preferred Embodiment)

A description will be given hereinbelow of a second preferred embodiment of this invention. FIG. 5 is a cross-sectional view showing a transformer forming a stationary induction apparatus according to the second embodiment when viewed from the above, and showing a winding insulating structure surround by an iron core. FIG. 5 substantially illustrates an upper half of a shell type transformer, and the lower half which is omitted from the illustration has a similar construction.

In FIG. 5, a plurality of coil pieces 4 forming current paths are connected to constitute high-voltage windings 2 and low-voltage windings 3. The high-voltage windings 2 and the low-voltage windings 3 run around a leg section 26 of an iron core 1. In the illustration, the high-voltage windings 2 and the low-voltage windings 3 are alternately disposed in the left- and right-hand directions. Other schematic constructions are similar to those in the above-described first embodiment and offer the same effects.

Although the present invention has been described and illustrated in detail, it is clearly understood that this is by way of illustration and example only and is not to be taken as limitations, the spirit and scope of the present invention being limited only by the appended claims.

What is claimed is:

1. A stationary induction apparatus comprising:

a winding including a plurality of coil pieces; and a plurality of electrostatic shield insulating layers surrounding said coil pieces, wherein each of said electrostatic shield insulating layers includes an electrical insulating layer, a first conductive layer on an inner surface of said electrical insulating layer, and a second conductive layer on an outside surface of said electrical insulating layer, at least a first of said coil pieces being surrounded by a first of said electrostatic shield insulating layers in a coil/shield combination, and a second of said coil pieces being surrounded by a second of said electrostatic shield insulating layers.

2. The stationary induction apparatus according to claim 1, wherein a capacitance between said first and second conductive layers of each of said electrostatic shield insulating layers is adjusted to control voltage distribution across said electrostatic shield insulating layers.

3. The stationary induction apparatus according to claim 1, further comprising an inter-layer insulating layer for covering at least one of an outer surface side of said first conductive layer and an inner surface side of said second conductive layer.

4. The stationary induction apparatus according to claim 1, wherein said first conductive layer and said second conductive layer are a non-magnetic material.

5. The stationary induction apparatus according to claim 1, wherein said first conductive layer and said second conductive layer comprise a conductive material having a coefficient of thermal expansion equivalent to a coefficient of thermal expansion of said electrical insulating layer.

6. The stationary induction apparatus according to claim 1, wherein said second conductive layer is equal in electric potential to said first conductive layer of said electrostatic shield insulating layer adjacent to and outside of said electrostatic shield insulating layer including said second conductive layer.

7. The stationary induction apparatus according to claim 6, including a capacitor having a capacitance larger than an inter-conductor series capacitance of said coil piece connected between said first conductive layer of an innermost electrostatic shield insulating layer and a first end of said winding and/or between said first conductive layer of an outermost electrostatic shield insulating layer and a second end of said winding.

8. The stationary induction apparatus according to claim 7, wherein a capacitance between said first conductive layer of the innermost electrostatic shield insulating layer and the first end of said winding and/or between said first conductive layer of the outermost electrostatic shield insulating layer and the second end of said winding is twice a capacitance between said first and second conductive layers of said electrostatic shield insulating layer.

9. The stationary induction apparatus according to claim 1, wherein said electric insulating layer is a composite insulating layer comprising a solid material having continuous microscopic cavities and a fluid filling the cavities.

10. The stationary induction apparatus according to claim 9, wherein said electrical insulating layer comprises cellulose.

11. The stationary induction apparatus according to claim 9, wherein said electric insulating layer is a laminated polymeric material.

12. The stationary induction apparatus according to claim 9, wherein said electric insulating layer comprises laminated thin sheets.

13. The stationary induction apparatus according to claim 1, wherein said first and second conductive layers of said electrostatic shield insulating layer are connected to said coil pieces inside and outside of said electrostatic shield insulating layer, respectively.

14. The stationary induction apparatus according to claim 13, wherein said first conductive layer is connected to an intermediate potential portion of said coil piece adjacent to and inside said first conductive layer, and said second conductive layer is connected to an intermediate potential portion of said coil piece adjacent to and outside said second conductive layer.

* * * * *